United States Patent [19]

Muckenfuhs

[11] Patent Number: 5,050,742

[45] Date of Patent: Sep. 24, 1991

[54] EASY OPENING PACKAGE CONTAINING COMPRESSED FLEXIBLE ARTICLES

[75] Inventor: Delmar R. Muckenfuhs, Middleton, Ohio

[73] Assignee: The Procter & Gamble Company, Cincinnati, Ohio

[21] Appl. No.: 608,661

[22] Filed: Nov. 2, 1990

[51] Int. Cl.[5] ..... B65D 85/16; B65D 85/18

[52] U.S. Cl. ..... 206/610; 206/440; 206/494; 206/609; 206/614; 206/615; 206/626; 383/120

[58] Field of Search ..... 206/83.5, 440, 494, 206/601, 607, 609, 610, 614, 615, 620, 626, 628, 630, 632; 383/10, 61, 120

[56] References Cited

U.S. PATENT DOCUMENTS

| | | | |
|---|---|---|---|
| D. 135,538 | 4/1943 | Kaplan . | |
| 655,998 | 8/1900 | Taylor . | |
| 1,261,612 | 4/1918 | Powers . | |
| 1,494,518 | 5/1924 | Whippey | 206/626 |
| 1,733,219 | 10/1929 | Duvall . | |
| 1,920,841 | 8/1933 | Clark | 100/14 |
| 2,011,236 | 8/1935 | Winter et al. | 206/57 |
| 2,127,118 | 8/1938 | Herbelin | 100/14 |
| 2,196,185 | 4/1940 | Belcher | 229/54 |
| 2,478,412 | 8/1949 | McMahan | 206/47 |
| 2,506,021 | 5/1950 | Homberg | 93/93 |
| 2,693,304 | 11/1954 | Davis et al. | 227/18 |
| 2,700,459 | 1/1955 | Anspacher | 206/46 |
| 2,750,096 | 6/1956 | Misch | 206/607 |
| 2,766,922 | 10/1956 | Moore | 206/626 |
| 2,781,161 | 2/1957 | Adams | 229/54 |
| 2,998,911 | 9/1961 | Hahn et al. | 229/66 |
| 3,006,119 | 10/1961 | Fingerhut | 53/24 |
| 3,044,228 | 7/1962 | Peterson | 53/24 |
| 3,056,245 | 10/1962 | Baum et al. | 53/24 |
| 3,059,387 | 10/1962 | Fasanella | 53/24 |
| 3,117,513 | 1/1964 | Burnett et al. | 100/215 |
| 3,124,298 | 3/1964 | Repko | 229/66 |
| 3,161,336 | 12/1964 | Loescher | 225/106 |
| 3,173,188 | 3/1965 | Wexler | 28/1 |
| 3,206,105 | 9/1965 | Smith | 229/55 |
| 3,327,449 | 6/1967 | Hullhorst et al. | 53/24 |
| 3,346,166 | 10/1967 | Koolins | 206/626 |
| 3,361,041 | 1/1968 | Grob | 93/8 |
| 3,370,630 | 2/1968 | Haugh et al. | 150/12 |
| 3,381,440 | 5/1968 | Hullhorst | 53/24 |
| 3,514,033 | 5/1970 | Goodwin | 229/54 |
| 3,548,723 | 12/1970 | Sengewald | 93/35 |
| 3,593,622 | 7/1971 | Sengewald | 93/35 |
| 3,605,570 | 9/1971 | Goodwin | 93/35 |
| 3,626,656 | 12/1971 | Langenscheidt | 53/59 R |
| 3,660,964 | 5/1972 | Willis et al. | 53/125 |
| 3,729,886 | 5/1973 | Lucas et al. | 53/24 |
| 3,792,564 | 2/1974 | Brady, Jr. | 53/124 E |
| 3,818,673 | 6/1974 | Rollins et al. | 53/24 |
| 3,824,759 | 7/1974 | Finn et al. | 53/24 |
| 3,977,596 | 8/1976 | Gamble | 229/54 |
| 4,031,815 | 6/1977 | Verbeke | 93/33 |
| 4,047,362 | 9/1977 | Lister et al. | 53/189 |
| 4,062,169 | 12/1977 | Lister et al. | 53/124 |
| 4,074,508 | 2/1978 | Reid | 53/62 |

(List continued on next page.)

*Primary Examiner*—David T. Fidei

*Attorney, Agent, or Firm*—R. C. Witte; J. V. Gorman; E. K. Linman

[57] ABSTRACT

A flexible package preferably comprised of paper and having an opening system that controls and reduces the initial removal forces required to withdraw the compressed flexible articles from the package after the opening device portion of the system has been activated. A reinforcement sheet located at the lowermost end of the opening system protects the flexible articles contained within the package prior to activation of the opening device, and provides additional support for the package prior to opening. A substantially vertically oriented line of weakness located in the reinforcement sheet ruptures automatically when the opening device is activated permitting the flexible articles to fan out further from the package. This automatic rupturing of the reinforcement sheet reduces the compressive forces acting upon the compressed flexible articles. This in turn permits easier removal of the first few flexible articles from the package either one at a time or in multiples.

20 Claims, 7 Drawing Sheets

U.S. PATENT DOCUMENTS

| | | | |
|---|---|---|---|
| 4,182,237 | 1/1980 | O'Brien | 100/35 |
| 4,216,899 | 8/1990 | Kamp | 229/54 |
| 4,241,562 | 12/1980 | Meyer | 53/438 |
| 4,252,269 | 2/1981 | Peppiatt | 229/54 |
| 4,328,655 | 5/1982 | Spencer et al. | 53/439 |
| 4,414,788 | 11/1983 | Berg | 53/436 |
| 4,501,107 | 2/1985 | Piotrowski | 53/438 |
| 4,539,705 | 9/1985 | Baines | 383/8 |
| 4,550,439 | 10/1985 | Peppiatt et al. | 383/8 |
| 4,573,203 | 2/1986 | Peppiatt | 383/8 |
| 4,577,453 | 3/1986 | Hofeler | 53/438 |
| 4,602,472 | 7/1986 | Ampolini et al. | 53/438 |
| 4,604,084 | 8/1986 | Pistner | 493/226 |
| 4,605,392 | 8/1986 | Achelpohl et al. | 493/196 |
| 4,607,388 | 8/1986 | Koiyumaki et al. | 383/121 |
| 4,608,808 | 9/1986 | Ryan et al. | 53/436 |
| 4,609,366 | 9/1986 | Ley et al. | 493/22 |
| 4,610,029 | 9/1986 | Huhtala et al. | 383/10 |
| 4,613,988 | 9/1986 | Maddock | 383/8 |
| 4,628,535 | 12/1986 | Tetenborg | 383/24 |
| 4,632,244 | 12/1986 | Landau | 206/219 |
| 4,633,649 | 1/1987 | Gautier et al. | 53/413 |
| 4,636,191 | 1/1987 | Piggott | 403/227 |
| 4,638,913 | 1/1987 | Howe, Jr. | 206/632 |
| 4,660,352 | 4/1987 | Deines et al. | 53/438 |
| 4,660,354 | 4/1987 | Lancaster et al. | 53/469 |
| 4,661,989 | 4/1987 | Risby | 383/2 |
| 4,664,957 | 5/1987 | van de Pol | 428/35 |
| 4,677,810 | 7/1987 | Spano | 53/428 |
| 4,685,276 | 8/1987 | Kiel | 53/459 |
| 4,686,815 | 8/1987 | Zils et al. | 53/469 |
| 4,688,369 | 8/1987 | Cornish et al. | 53/436 |
| 4,688,370 | 8/1987 | Dighton et al. | 53/469 |
| 4,688,372 | 8/1987 | Langen et al. | 53/529 |
| 4,691,369 | 9/1987 | Costa | 383/17 |
| 4,694,638 | 9/1987 | Maddux, Jr. et al. | 53/459 |
| 4,696,050 | 9/1987 | Sengewald | 383/10 |
| 4,696,145 | 9/1987 | Schmidt et al. | 53/436 |
| 4,699,608 | 10/1987 | Pistner | 493/204 |
| 4,702,731 | 10/1987 | Lambrecht et al. | 493/196 |
| 4,703,517 | 10/1987 | Marino | 383/7 |
| 4,704,100 | 11/1987 | Kaufman | 493/194 |
| 4,706,440 | 11/1987 | Bittner | 53/438 |
| 4,710,967 | 12/1987 | Petschner | 383/8 |
| 4,711,066 | 12/1987 | Fox et al. | 53/436 |
| 4,711,067 | 12/1987 | Magni | 53/439 |
| 4,713,135 | 12/1987 | Bridgeford | 156/218 |
| 4,713,839 | 12/1987 | Peppiatt | 383/29 |
| 4,715,635 | 12/1987 | Koskinen | 294/68/1 |
| 4,717,262 | 1/1988 | Roen et al. | 383/120 |
| 4,720,872 | 1/1988 | Kaczerwaski | 383/8 |
| 4,721,396 | 1/1988 | Sengewald | 383/8 |
| 4,730,942 | 3/1988 | Fulcher | 383/7 |
| 4,730,943 | 3/1988 | Johnson | 383/8 |
| 4,738,078 | 4/1988 | Benz et al. | 53/439 |
| 4,738,546 | 4/1988 | Sengewald | 383/7 |
| 4,846,587 | 7/1989 | Hull | 383/10 |
| 4,874,255 | 10/1989 | Ball et al. | 383/8 |
| 4,934,535 | 6/1990 | Muckenfuhs et al. | 206/610 |
| 4,966,286 | 10/1990 | Muckenfuhs | 206/610 |

FOREIGN PATENT DOCUMENTS

| | | |
|---|---|---|
| 258573 | 3/1988 | European Pat. Off. . |
| 349050 | 1/1990 | European Pat. Off. . |
| 3102192 | 9/1982 | Fed. Rep. of Germany . |
| 3629563 | 8/1986 | Fed. Rep. of Germany . |
| 3642327 | 8/1986 | Fed. Rep. of Germany . |
| 8621549 | 11/1986 | Fed. Rep. of Germany . |
| 1022595 | 3/1966 | United Kingdom . |
| 1282769 | 7/1972 | United Kingdom . |
| 2035258 | 6/1980 | United Kingdom . |

EASY OPENING PACKAGE CONTAINING COMPRESSED FLEXIBLE ARTICLES

FIELD OF INVENTION

The present invention relates to an improved package comprising a paper bag containing compressed flexible articles and more particularly, to an opening system that controls and reduces the initial removal forces acting on the compressed flexible articles.

BACKGROUND INFORMATION

Flexible articles like, for example, single use diapers are often packed either in cardboard boxes or in flexible bags made of plastic film. However, cardboard is heavy, taking up more space than plastic and has less flexibility for storing since it is rigid, and in use continues to take up the same amount of space, even when nearly empty. Cardboard has the advantage of being biodegradable or recyclable since paper recycling facilities are already in place. Plastic bags, which are lighter and allow more flexibility, are not biodegradable and currently recycling facilities are in very limited use.

In order to decrease the quantity of packaging material needed for packing flexible articles, they are being compressed before packing. Compressing the flexible articles has led to a reduction in the amount of empty packing material to dispose and has reduced costs. Commonly assigned EPO Patent Application 89201611.4 discloses one such flexible bag containing compressed flexible articles.

Commonly assigned British Patent Application 8923835.6 discloses another flexible bag filled with compressed flexible articles. This application discloses a package made of paper, a material that is easily biodegradable and for which recycling facilities are currently in place. However, experience has demonstrated that the opening system disclosed in British Patent Application 8923835.6 requires high initial removal forces, thereby impeding easy removal of the first few compressed flexible articles from the paper package.

SUMMARY OF THE INVENTION

Accordingly, it is an object of this invention to provide an opening system to reduce and control the initial removal forces acting upon the compressed flexible articles.

It is a further object of this invention to provide an opening system that is compatible with existing manufacturing and packaging equipment.

It is a further object of this invention to provide a paper bag and opening system for containing compressed flexible articles said bag being easily biodegradable and/or recyclable.

The aforementioned and other objects of the present invention will become more apparent hereinafter.

In accordance with the objects of the present invention there is provided a substantially rectangular flexible package containing compressed flexible articles. The package has a front and a back panel connected to one another by a pair of side panels, a bottom panel and a top panel. All of the panels are made of a flexible material. A carrying device preferably extends from the top panel of the flexible package. An easy opening device comprising a pair of vertical lines of weakness is preferably located on one of the side panels. The lines of weakness, which typically comprise perforations, define a portion of the side panel that is to be at least partially separated from the remainder of the side panel without releasing the tension in the remainder of the side panel. This is accomplished by applying a grasping force to a tear flap that extends from the lowermost end of the opening device and tearing upwardly along the lines of weakness.

When the easy opening device is fully activated the flexible articles expand in a fan-like array through the aperture in the side panel while the portion of the flexible articles coinciding with the remaining tensioned portion of the side panel remain substantially compressed.

A reinforcement sheet is located beneath the tear flap and is fastened to the inner surface of the flexible package. The reinforcement sheet prevents the product contained within the package from being exposed or soiled in the area coinciding with the pivotally connected flap that extends from the lowermost end of the easy opening device. The reinforcement sheet also contains a vertically oriented line of weakness that is designed to automatically rupture under the force of the compressed flexible articles when the easy opening device in the side panel is activated. Upon rupture of the reinforcement sheet, the flexible articles are allowed to expand further through the aperture in the side panel in a fan-like array, while the portion of the articles coinciding with the remaining tensioned portion of the side panel remains substantially compressed. Because the uncompressed area of the articles is increased by rupture of the reinforcement sheet, removal forces are reduced, particularly for the first few articles removed from the package.

BRIEF DESCRIPTION OF THE DRAWINGS

While the specification concludes with claims particularly pointing out and distinctly claiming the subject invention, it is believed that the same will be better understood from the following description taken in conjunction with the accompanying drawings in which:

DESCRIPTION OF THE PREFERRED EMBODIMENTS

Figure 1:
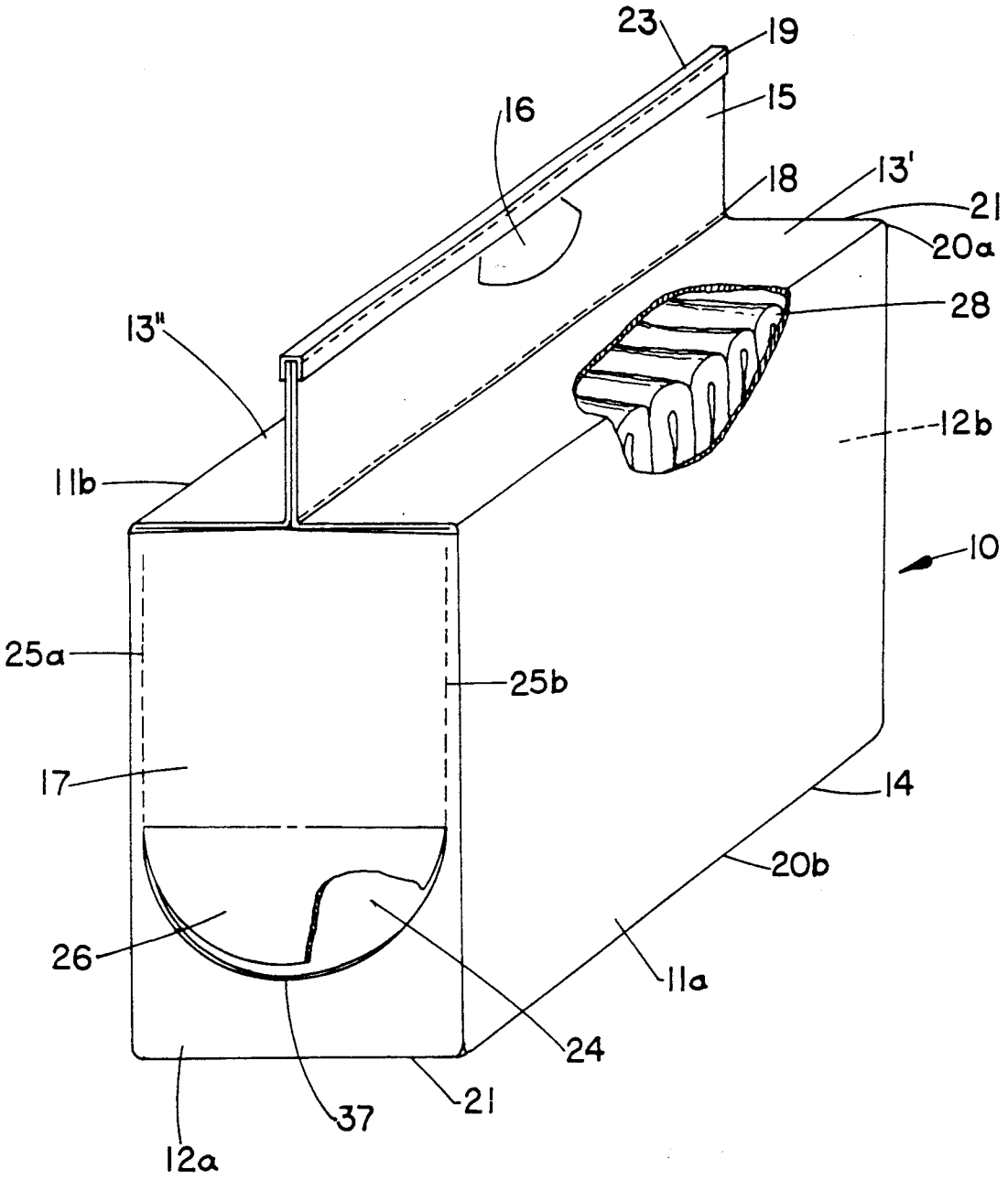
FIG. 1 is a perspective view of a package comprising a side gussetted paper bag containing compressed flexible articles.

As can be seen from FIG. 1, package (10) generally has the shape of a parallelepiped and represents a filled side gussetted paper bag comprising front panel (11*a*) and back panel (11*b*), side panels (12*a* and 12*b*), top panel (13) and bottom panel (14). Top panel (13) comprises two sections (13' and 13''), that are secured to one another along joinder line (18). Those upwardly extending sections (13' and 13'') that are located above joinder line (18) form an extension (15) in which carrying device (16) is provided. An easy opening device (17) is preferably provided in side panel (12*a*). The material used in package (10) is preferably made of paper or any recyclable material and laminate structures comprised of two or more of the aforementioned materials. In addition package (10) may also be made of nonbiodegradable or nonrecyclable material, e.g., polymeric films that employ the same structure of the described package.

Such a side gussetted paper bag may be formed in a conventional way by folding paper from a roll into a side gussetted tube glued at the side seam, then cutting individual bags from the tube and grouping them into wickets. The top of each bag is preferably closed before filling by sewing or thermosealing along joinder line (18), thereby forming extension (15) which preferably finishes in another line of sewing or thermosealing (19). Horizontal scorelines (20*a* and 20*b*) are provided in the locations which will delimit the upper and lower edge of the stack of compressed articles to be inserted in the bag, in the front and back panels, while diagonal scorelines (21) delimit the upper and lower edge of the stack of compressed articles in the side panels.

The scorelines (20*a*) provided in the upper part of the paper bag facilitate erecting the empty bag into the shape of a parallelepiped for easy insertion of the compressed flexible products through the bottom, while scorelines (20*b*) provided in the lower part of the paper bag facilitate the folding of the paper bag to form bottom panel (14) which is to be sealed or glued after filling. The compressed flexible articles (28) may be loaded into package (10) through the bottom in a method similar to that disclosed in commonly assigned U.S. Pat. No. 4,934,535 issued to Muckenfuhs et al on Oct. 2, 1989, which is hereby incorporated by reference.

It is especially advantageous to secure the flaps used to form bottom panel (14) with the help of a thermoactivated glue applied on the inside of the bag bottom via printing during the bag forming process, since this securement method allows the use of existing sealing apparatus normally used to seal polybags.

The carrying device (16), which is provided in the extension (15), can comprise a conventional grip-hole cutout. Particularly preferred shapes for the cutout are disclosed in commonly assigned U.S. Pat. No. 4,846,587 issued to Hull on July 11, 1989, which is hereby incorporated by reference. As can be seen from FIG. 2, this grip-hole is preferably reinforced by an intermediate layer of biodegradable material such as unbleached paper, paperboard, or paper with cotton or other natural string reinforcement (22).

At the time the upper extension (15), which comprises vertical extensions of top panel sections (13' and 13'') is sewn or otherwise secured along its free edge, a U-shaped protective member (23) is preferably slid over the free top edges of extension (15). This U-shaped protective member can, if desired, be sewn in the same sewing operation. The U-shaped protective member is also, preferably comprised of a biodegradable material, such as paper.

The easy opening device which is shown in FIG. 1 is preferably positioned in side gusset/side panel (12*a*). It is positioned substantially perpendicular to the compression direction of the flexible articles packed in the paper bag so that, after opening of the device, the compressed flexible articles (28) are partially released from the compressive forces and can be taken out one after the other or in multiples, without further tearing of the remaining portions of the paper bag, which continue to protect the unused articles. This can best be seen in FIG. 3.

Figure 2:
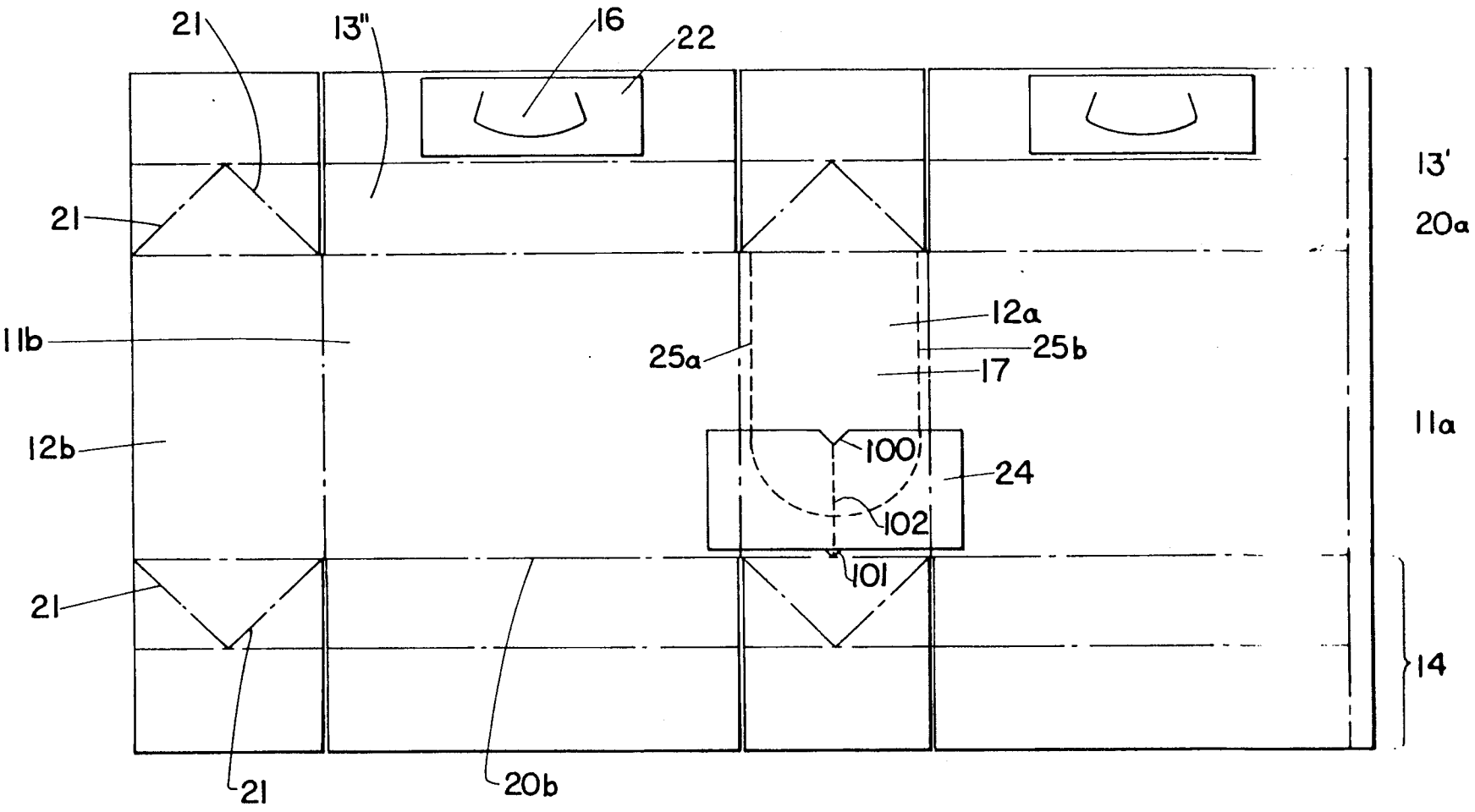
FIG. 2 is a flat blank of the 1 or 2 layer paper before it is formed into a bag.

The preferred opening device (17) shown in FIG. 2 comprises lines of weakness (25*a* and 25*b*). A tear flap extends from the lowermost end of opening device (17). Opening device (17) is preferably employed in conjunction with an internal reinforcement sheet (24) made of a suitable biodegradable and/or recyclable material such as paper, paperboard, cotton cloth, etc.

As will be appreciated from the accompanying drawing figures, compressed flexible articles (28) will be shielded from exposure prior to opening of package (10) by the addition of reinforcement sheet (24). Without the addition of reinforcement sheet (24) compressed flexible articles (28) could be partially exposed prior to activation of opening device (17).

Reinforcement sheet (24) is preferably glued or otherwise secured to the inside of the bag at least on the side panel (12*a*) in which the opening device (17) is provided, but can be of a sufficient width to overlap the folds between side panel (12*a*) and front panel (11*a*) and back panel (11*b*). A shaped cutting (37) is provided in the bag's side panel (12*a*) in order to generate a loose tear flap (26) which preferably interconnects the lowermost ends of lines of weakness (25*a*) and (25*b*) to one another. Tear flap (26) is preferably glued (not shown) to reinforcement sheet (24) approximately 1 to 5 mm below the top edge of the reinforcement sheet in order to insure that the bag remains substantially closed prior to activation of the easy opening device (17).

Figure 3:
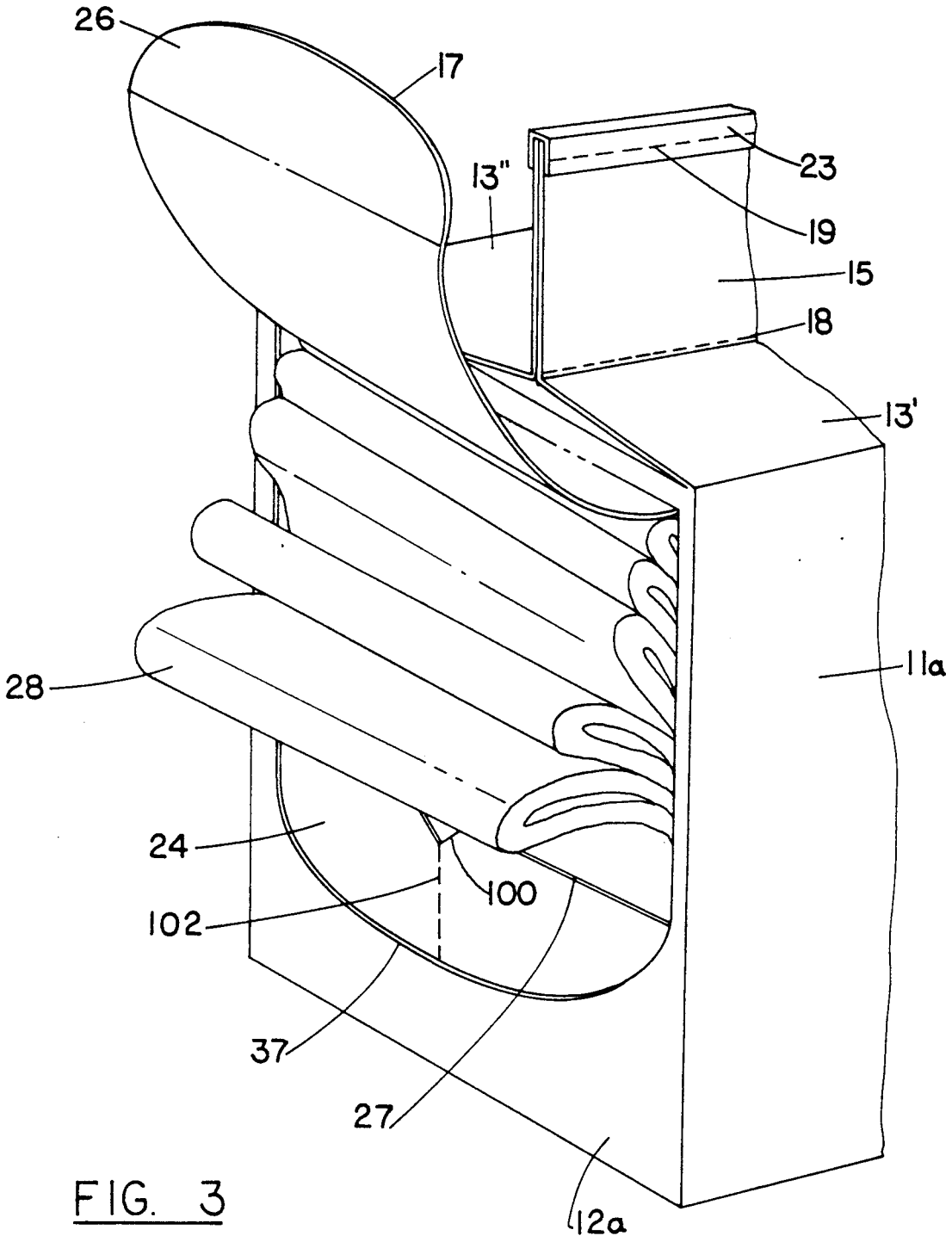
FIG. 3 is a fragmentary perspective view of the package embodiment of FIG. 1 with the easy opening device partially torn upwards and prior to rupture of the line of weakness in the underlying reinforcement sheet.
Figure 4:
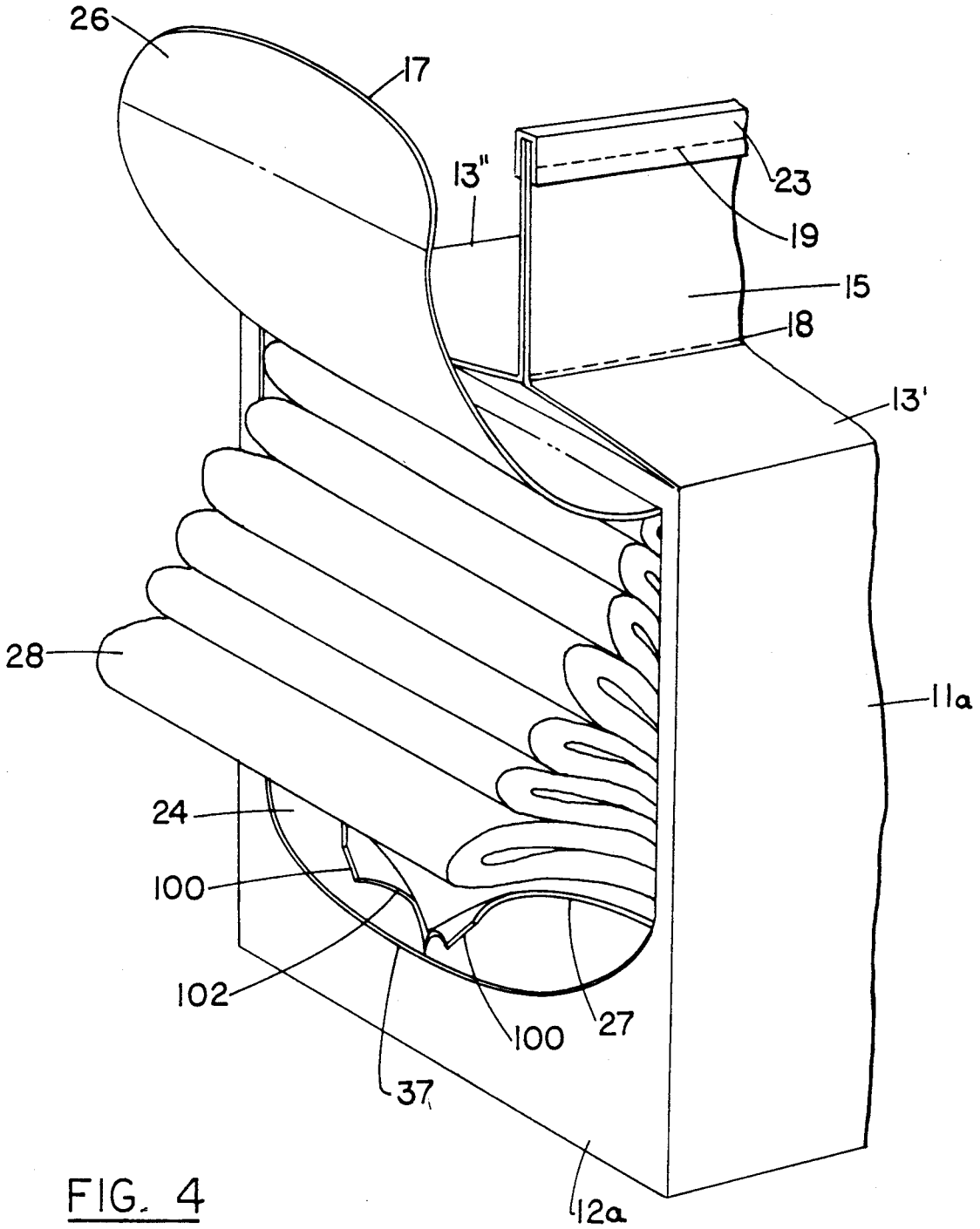
FIG. 4 is a fragmentary perspective view of the embodiment of FIGS. 1 and 2 with the opening device fully torn upwards and after rupture of the perforations in the reinforcement sheet.

Reinforcement sheet (24) shown in FIGS. 2, 3, and 4, preferably includes a cutout notch (100) and a line of weakness preferably comprising perforations (102). Tab (101) at the bottom of the sheet is mainly the result of cutting successive reinforcement sheets from a continuous web with a single blade. The addition of cutout notch (100) and perforations (102) to reinforcement sheet (24) help ensure automatic rupture of the reinforcement sheet (24) and hence further release of compressed flexible articles (28) after opening device (17) has been activated. Automatic rupture of line of perforations (102) eliminates the need for coating the inner surface of reinforcement sheet (24) in order to reduce the surface friction and hence the initial removal forces acting upon the first few compressed flexible articles (28) to be removed from the opened package.

FIGS. 3 and 4 illustrate the functioning of line of perforations (102) relative to further release of the compressive forces acting upon compressed flexible articles (28) within package (10) upon opening of the package.

Figure 5A:
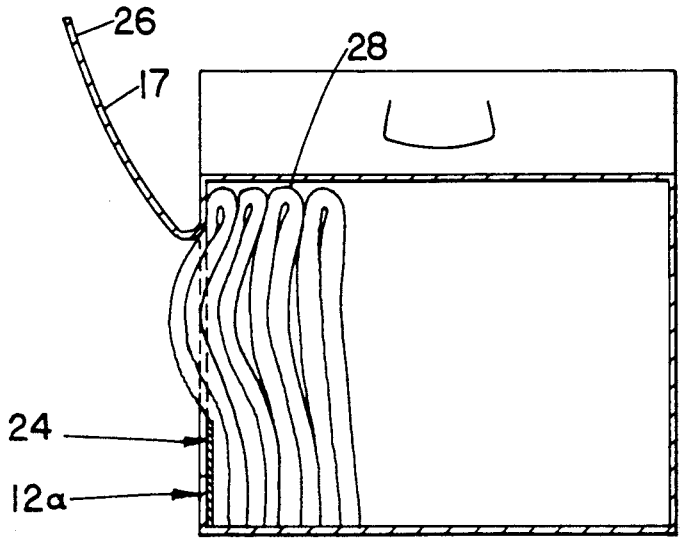
FIGS. 5A, 5B, and 5C are sequential drawings illustrative of the gradual release of the compressive forces acting upon the articles, allowing them to fan out from the package as the opening device is activated.
Figure 5B:
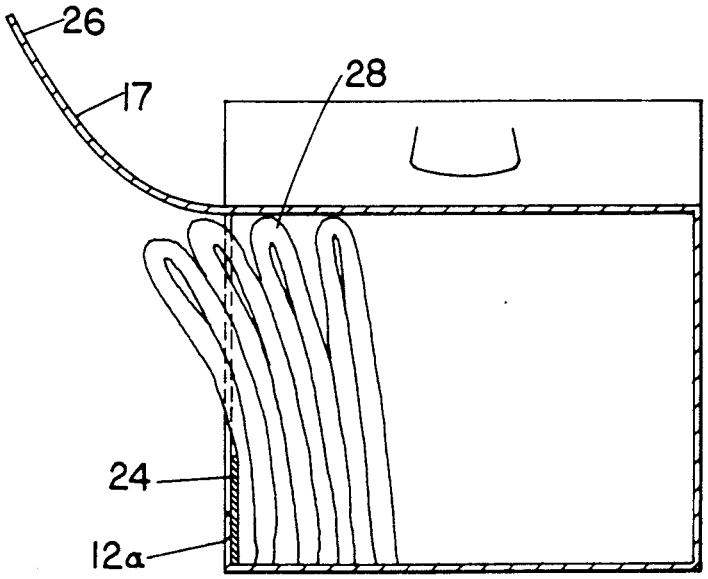
Figure 5C:
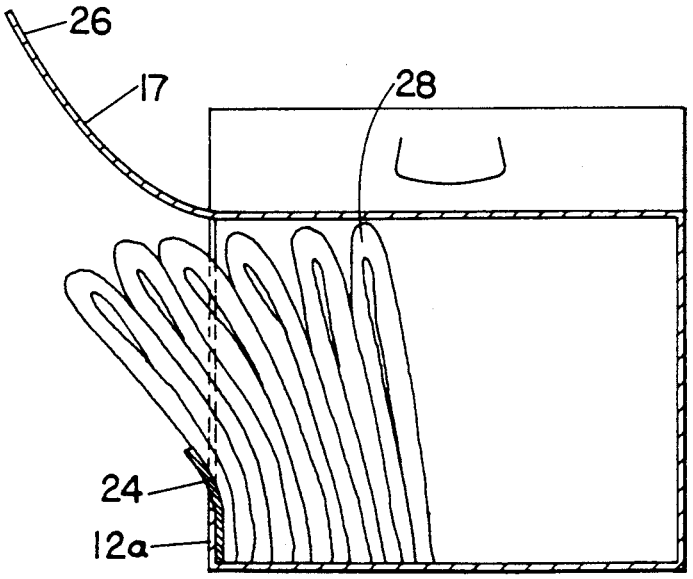

Turning now to FIGS. 5A, 5B, and 5C, the operation of opening device (17) in conjunction with reinforcement sheet (24) is illustrated. Initially, opening package (10) begins by applying an upward grasping force to tear flap (26) on opening device (17). As opening device (17) is activated, the compressive forces acting upon compressed flexible articles (28) begin to release, and compressed flexible articles (28) begin to expand through the opening created in side panel (12*a*), as shown in FIG. 5A.

When opening device (17) is fully activated, the tops of compressed flexible articles (28) are permitted to fan out from package (10), but are restrained at their lower end by reinforcement sheet (24), as shown in FIG. 5B. This would be the final position of compressed flexible articles (28) without the addition of a line of weakness preferably comprising perforations (102) in reinforcement sheet (24). Absent perforations (102), the initial removal forces necessary to remove compressed flexible articles (28) will remain high because the area over which the compressive forces act is still high near the lowermost end portion of the articles. However, the perforations (102) in reinforcement sheet (24) automatically rupture when opening device (17) is fully activated, as generally shown in FIG. 5C, as a result of the compressive force acting upon them. This releases more of the compressive forces acting upon compressed flexible articles (28). As a result, the initial removal forces needed by the user to withdraw the first few articles from the package will be significantly reduced. This reduction in force acting on compressed flexible articles (28) either one at a time or in multiples.

Figure 6:
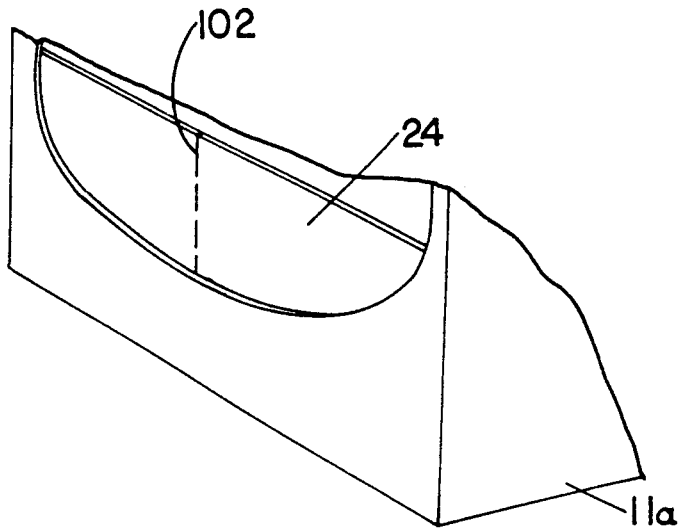
FIG. 6 is a view of a reinforcement sheet embodiment wherein the cutout notch shown in FIG. 3 is replaced with a continuous slit at the junction of the line of weakness with the top edge of the reinforcement sheet.

While the preferred embodiment of reinforcement sheet (24) shown in FIGS. 1–4 has a cutout notch (100) located at the juncture between line of perforation (102), and the uppermost end of reinforcement sheet (24), it is possible to replace cutout notch (100) with a continuous vertical slit at the junction of the perforation line (102) with the upper edge of reinforcement sheet (24), as generally shown in FIG. 6. This slit would act in a manner generally similar to cutout notch (100) in providing a starting point for the automatic rupture of the line of perforations (102).

Figure 7:
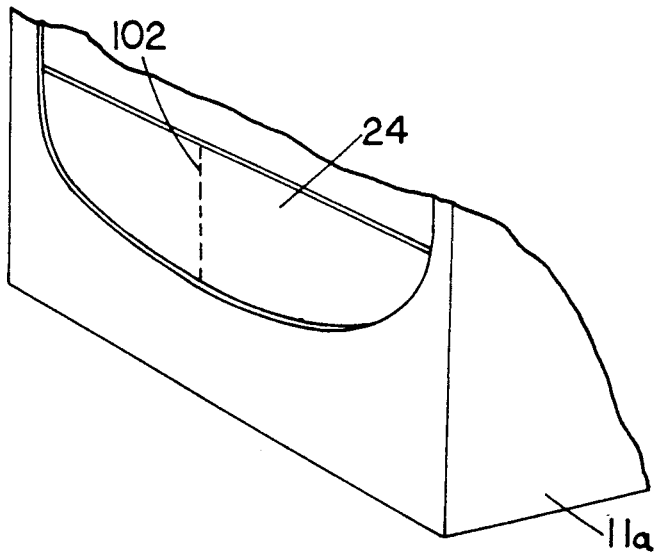
FIG. 7 is a view of a reinforcement sheet embodiment wherein a cut in the line of the perforations does not intersect the top edge of the reinforcement sheet.

Another embodiment of reinforcement sheet (24) includes a continuous line of perforations (102) in which the top edge of reinforcement sheet (24) does not coincide with one of the cut areas in the line of perforations (102), as generally shown in FIG. 7. Furthermore, line of perforations (102) may be replaced with other types of lines of weakness, e.g., scorelines, creases, partial cuts or other means of weakening reinforcement sheet (24) to permit substantially automatic rupture of the substantially continuous line of weakness upon activation of easy opening device (17). In addition, multiple lines of perforations (102) or any of the weakening means previously mentioned may be employed in parallel with one another in a plurality of locations along reinforcement sheet (24).

In the previously described embodiments of reinforcement sheet (24) employing a line of perforations (102), the total force needed to produce automatic rupture can be adjusted as desired by adjusting the relative ratio of open cut area versus uncut land area. Thus, for any given compressive loading the size and shape of opening device (17), the positioning of the uppermost edge of reinforcement sheet (24), and the design of line of weakness (102) in reinforcement sheet (24) can be adjusted to produce the desired opening characteristics in the package (10).

Figure 8:
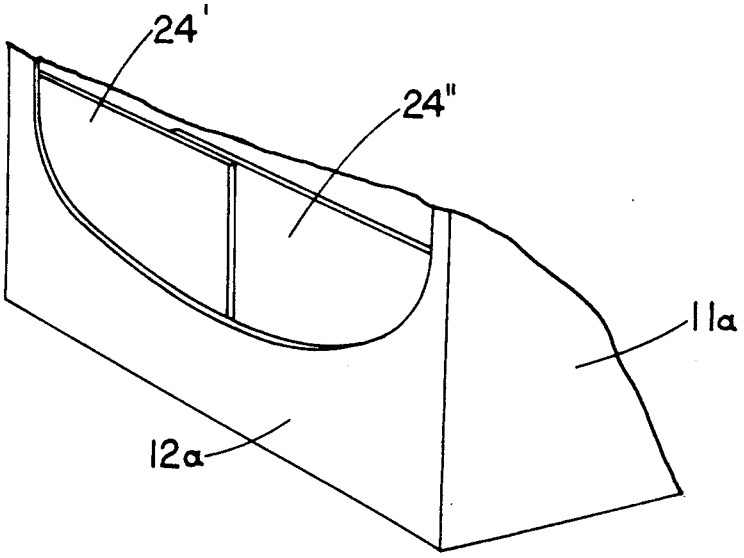
FIG. 8 is a view of an embodiment wherein the single reinforcement sheet has been replaced by two separate sheets which overlap one another.

In still another embodiment of the present invention the single reinforcement sheet (24) with line of weakness (102) can be replaced by two overlapping separate sheets (24′ and 24″) which are preferably unsecured to one another to function in a manner somewhat similar to single reinforcement sheet (24). This embodiment is shown in FIG. 8. In this later embodiment, shifting of the separate sheets (24′ and 24″) relative to one another when the opening device (17) is activated will allow the compressive forces acting on compressed flexible articles (28) to be further reduced without the need for rupture of either sheet.

Figure 9:
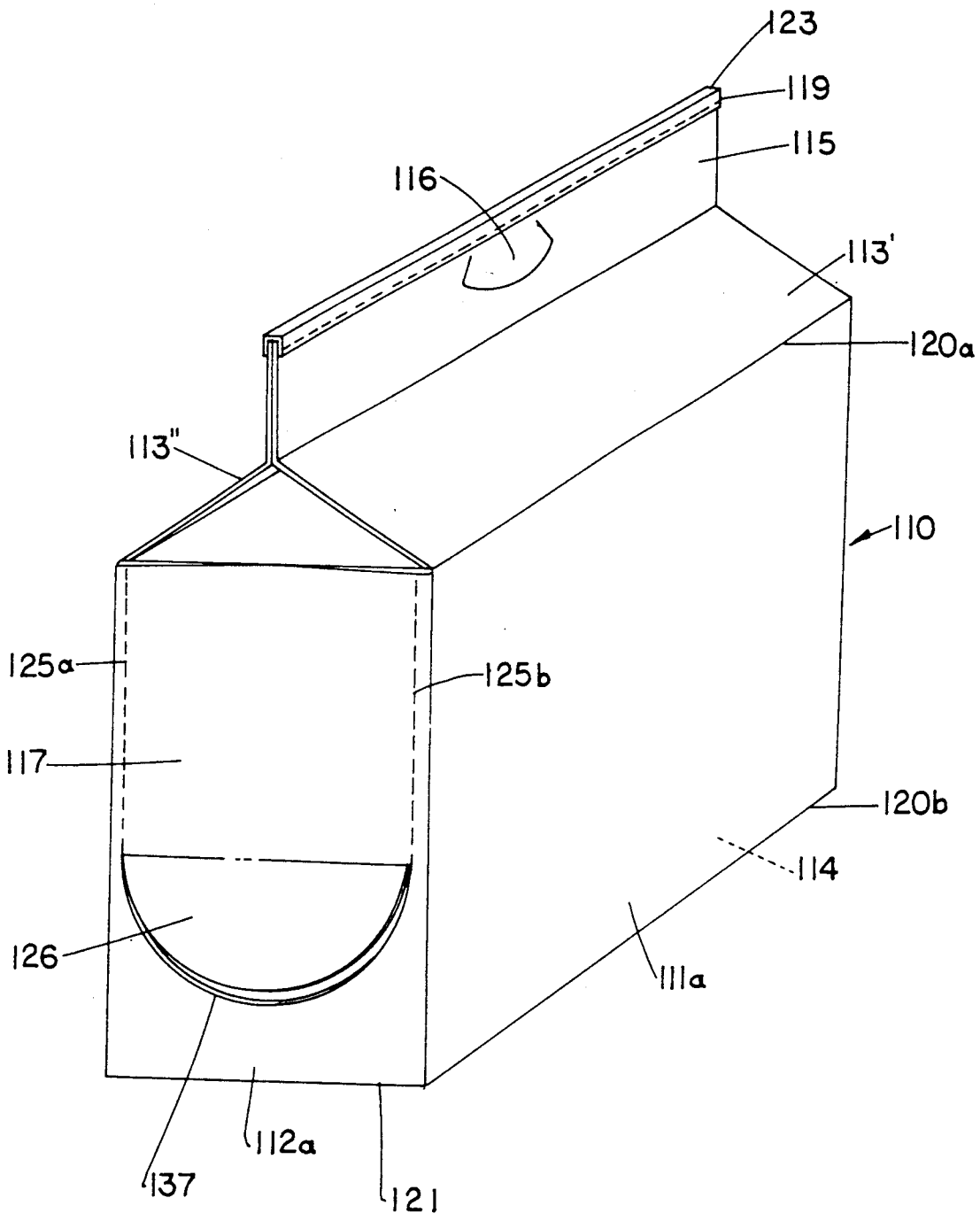
FIG. 9 is a perspective view of an alternative package of the present invention comprising a top gussetted paper bag containing compressed flexible articles.

Although the present invention has been described in conjunction with a side gussetted bag, it will be clearly understood from FIG. 9 that it can work equally well with a top gussetted bag (110). The numerals used in FIG. 9 show the same features as described in the previous figures with like numerals designating like elements. It will be evident that opening device embodiments of the type generally illustrated in FIG. 5 can be provided with equal facility on the top gussetted bag (110) shown in FIG. 9.

Various modifications of the present invention will be apparent to those of ordinary skill in the art. The embodiments disclosed herein are merely exemplary. Accordingly, the scope of the present invention should be construed in light of the following claims and is not to be limited to specific details of the exemplary structures described and shown in the present specification and drawings.

What is claimed is:

1. A substantially rectangular flexible package containing compressed flexible articles, said flexible package comprising:

(a) a front and a back panel connected to one another by means of a pair of side panels, a bottom panel and a top panel;

(b) an opening device comprising a pair of substantially vertically oriented lines of weakness located within one of said side panels of said flexible package, said substantially vertically oriented lines of weakness defining a predetermined portion of said side panel to be at least partially separated from the remainder of said side panel without releasing the tension in the remainder of said side panel, said predetermined portion of said side panel being partially separated by applying a grasping force to a tear flap extending from the lowermost end of said opening device, whereupon said flexible articles coinciding with the aperture thus formed in said side panel expand through said aperture in a fan-like array while the portion of said flexible articles coinciding with the remaining tensioned portion of said side panel are retained in a substantially compressed condition;

(c) an internal reinforcement sheet comprised of flexible material located on the innermost surface of said side panel containing said opening device and said tear flap, said reinforcement sheet substantially coinciding with said tear flap and having an uppermost end substantially coinciding with the point of joinder between the lowermost end of said opening device and the uppermost end of said tear flap; and (d) a substantially vertically oriented line of weakness located in said reinforcement sheet, said substantially vertically oriented line of weakness being automatically rupturable by the expansion of said compressed flexible articles when said opening device is activated, thereby releasing the tension in said reinforcement sheet, whereupon said compressed flexible articles expand through the portion of said aperture coinciding with said reinforcement sheet in a fan-like array while the portion of said compressed flexible articles coinciding with the remaining tensioned portion of said side panel are retained in a substantially compressed condition.

2. The flexible package of claim 1, wherein the material comprising said flexible package is biodegradable and/or recyclable.

3. The flexible package of claim 1, wherein the material comprising said flexible package is selected from the group consisting of papers, polymeric films, nonwovens and laminate structures comprised of two or more of the aforementioned materials.

4. The flexible package of claim 1, wherein said substantially vertically oriented line of weakness located in said reinforcement sheet comprises a line of perforations.

5. The flexible package of claim 1, wherein said reinforcement sheet includes a plurality of substantially vertically oriented lines of weakness.

6. The flexible package of claim 5, wherein said plurality of said substantially vertically oriented lines of weakness located in said reinforcement sheet comprise lines of perforations.

7. The flexible package of claim 1, wherein said substantially vertically oriented lines of weakness located in said side panel and defining the limits of said opening device comprise lines of perforations.

8. The flexible package of claim 1, wherein said reinforcement sheet comprises a pair of overlapping sheets of flexible material which are unsecured to one another.

9. The flexible package of claim 1 further comprising an extension extending from said top panel of said flexible package, including a carrying device comprising a grip-hole cutout.

10. The flexible package of claim 9, wherein said carrying device comprising said grip-hole cutout is reinforced about its periphery by a layer of biodegradable and/or recyclable material.

11. The flexible package of claim 9, further comprising a U-shaped biodegradable and/or recyclable protective member slid over the uppermost edge of said extension and attached thereto by a sewing line.

12. The flexible package of claim 11, wherein said carrying device comprising said grip-hole cutout is located adjacent said sewing line.

13. The flexible package of claim 1, wherein said tear flap joined to the lowermost end of said opening device is temporarily secured to said reinforcement sheet prior to activation of said opening device.

14. The flexible package of claim 1, wherein said tear flap joined to the lowermost end of said opening device is coated with a pressure sensitive adhesive on at least a portion of its innermost surface to permit repeatedly attaching and detaching said tear flap to said reinforcement sheet.

15. A substantially rectangular flexible package containing compressed flexible articles, said flexible package comprising:

(a) a front and a back panel connected to one another by means of a pair of side panels, a bottom panel and a top panel;

(b) a carrying device extending from said top panel;

(c) an opening device comprising a pair of substantially vertically oriented lines of weakness located within one of said side panels of said flexible package, said substantially vertically oriented lines of weakness defining a predetermined portion of said side panel to be at least partially separated from the remainder of said side panel without releasing the tension in the remainder of said side panel, said predetermined portion of said side panel being partially separated by applying a grasping force to a tear flap extending from the lowermost end of said opening device, whereupon said flexible articles coinciding with the aperture thus formed in said side panel expand through said aperture in a fan-like array while the portion of said flexible articles coinciding with the remaining tensioned portion of said side panel are retained in a substantially compressed condition;

(d) an internal reinforcement sheet comprised of flexible material located on the innermost surface of said side panel containing said opening device and said tear flap, said reinforcement sheet substantially coinciding with said tear flap and having an uppermost end substantially coinciding with the point of joinder between the lowermost end of said opening device and the uppermost end of said tear flap; and (e) a substantially vertically oriented line of weakness located in said reinforcement sheet, said substantially vertically oriented line of weakness being automatically rupturable by the expansion of said compressed flexible articles when said opening device is activated, thereby releasing the tension in said reinforcement sheet, whereupon said compressed flexible articles expand through the portion of said aperture coinciding with said reinforcement sheet in a fan-like array while the portion of said compressed flexible articles coinciding with the remaining tensioned portion of said side panel are retained in a substantially compressed condition.

16. The flexible package of claim 15, wherein said substantially vertically oriented line of weakness located in said reinforcement sheet comprises a line of perforations.

17. The flexible package of claim 15, wherein said reinforcement sheet includes a plurality of substantially vertically oriented lines of weakness.

18. The flexible package of claim 17, wherein said plurality of said substantially vertically oriented lines of weakness located in said reinforcement sheet comprise lines of perforations.

19. The flexible package of claim 15, wherein said substantially vertically oriented lines of weakness located in said side panel and defining the limits of said opening device comprise lines of perforations.

20. The flexible package of claim 15, wherein said reinforcement sheet comprises a pair of overlapping sheets of flexible material which are unsecured to one another.

* * * * *